United States Patent [19]

Flinn et al.

[11] 4,285,784

[45] Aug. 25, 1981

[54] PROCESS OF ELECTROPLATING A PLATINUM-RHODIUM ALLOY COATING

[75] Inventors: David R. Flinn, Fort Washington; Cheryl L. Manger, Laurel, both of Md.

[73] Assignee: The United States of America as represented by the Secretary of the Interior, Washington, D.C.

[21] Appl. No.: 168,822

[22] Filed: Jul. 10, 1980

[51] Int. Cl.[3] ..... C25D 3/66

[52] U.S. Cl. ..... 204/39

[58] Field of Search ..... 204/39, 43 N, 123, 71

[56] References Cited

U.S. PATENT DOCUMENTS

| | | | |
|---|---|---|---|
| 1,779,436 | 10/1930 | Keitel | 204/47 |
| 1,779,457 | 10/1930 | Zschiegner | 204/47 |
| 2,093,406 | 9/1937 | Atkinson | 204/39 |
| 3,276,976 | 10/1966 | Juliard | 204/43 N |
| 3,309,292 | 3/1967 | Andrews et al. | 204/39 |
| 3,547,789 | 12/1970 | Andrews et al. | 204/39 |
| 3,671,408 | 6/1972 | Martini | 204/43 N |

OTHER PUBLICATIONS

Abner Brenner, "Electrodeposition of Alloys", vol. II, pp. 544–546, (1963).

G. R. Smith et al., Plating, pp. 805–808, Jul. 1969.

William B. Harding, Plating and Surface Finishing, pp. 48–55, Sep. 1977.

*Primary Examiner*—G. L. Kaplan

*Attorney, Agent, or Firm*—William S. Brown; Donald A. Gardiner

[57] ABSTRACT

The present invention provides a process of electroplating a platinum-rhodium alloy coating of predetermined composition and predetermined thickness on a metal substrate. The composition is substantially uniform throughout the electrodeposited coating. The process includes the steps of electrolytically dissolving an anode made of platinum or rhodium into a molten cyanide bath to prepare separately a platinum bath and a rhodium bath, forming a mixed bath having a predetermined ratio of platinum to rhodium from the separate platinum and rhodium baths, and electroplating platinum and rhodium onto a metal substrate, using a predetermined electrical charge and alternating a platinum anode with a rhodium anode, while monitoring and controlling the deposition potential of the metal substrate. This coating substantially corresponds in composition to the composition of the mixed bath. The process is carried out in a dry, inert gas environment. The molten cyanide bath is moisture-free, and there is immersed in this bath a selective ion transport membrane, such as a Pyrex, that maintains the cathode in a moisture-free cyanide bath separate from the bath in which the anode is immersed. Also provided is a process wherein the electroplating step is followed by an alloy electrodissolution step.

10 Claims, No Drawings

PROCESS OF ELECTROPLATING A PLATINUM-RHODIUM ALLOY COATING

TECHNICAL FIELD

This invention relates to the field of electrodeposition of metals. More specifically, it is related to a process of obtaining a platinum-rhodium alloy coating of predetermined composition and predetermined thickness, the composition being substantially uniform throughout the electroplated coating.

BACKGROUND ART

It is known to form a platinum-rhodium alloy from an aqueous bath containing platinum and rhodium. Illustrative of this prior art is U.S. Pat. No. 2,027,358 to Powell et al., U.S. Pat. No. 3,276,976 to Juliard, U.S. Pat. No. 3,671,408 to Martini and U.S. Pat. No. 3,748,712 to Karawin. Also known is the formation of a molten cyanide bath containing a platinum group metal, with U.S. Pat. No. 2,093,406 to Atkinson and U.S. Pat. No. 4,149,942 to von Stutterheim being exemplary of this type of art. Also, we have given oral presentations of the methods described below to prepare the individual platinum- and rhodium-containing molten cyanide baths in 1976 and 1978.

The deposition of coatings of various platinum metals from molten alkali cyanide baths is reported in R. N. Rhoda, *Plating,* Vol. 49, pp. 69–71 (January, 1962), and U.S. Pat. No. 3,309,292 to R. L. Andrews et al. Additionally, the prior art, as illustrated by U.S. Pat. No. 3,547,789 to R. L. Andrews, G. R. Smith, C. B. Kenahan and D. Schlain, discloses obtaining an alloy of platinum or palladium with another platinum group metal by electrolytically dissolving the platinum or palladium, and the other platinum group metal, separately in a molten alkali metal cyanide bath to form a metal cyanide complex, combining the resulting baths, and electroplating the alloy onto the desired substrate. In this Andrews patent, it is essential in the preparation of the metal cyanide complex to expose the molten bath to air or oxygen either before or during the introduction of primary metal, and it is essential to expose the bath to air or oxygen at temperatures of 600° C. or less to ensure the continued and repeated formation of coatings of 5 or more mils in thickness. Only example 5 shows operation of a plating bath in the absence of air, and this bath is a palladium bath.

In the later work of two of the inventors of this Andrews patent, it was reported that the preparation and use of a molten platinum cyanide bath in an inert atmosphere, using either sodium cyanide or a sodium and potassium cyanide mixture, was unsuccessful, since the deposits obtained were always thin, and the cathode current efficiencies were only 1 or 2%. It was also reported that in the absence of air, almost all of the platinum removed from the anodes precipitated and settled to the bottom of the melt. Similarly, it was reported that attempts to prepare and use molten palladium cyanide baths in inert atmospheres were unsuccessful. These reports are contained in D. Schlain, F. X. McCawley, and G. R. Smith, Report of Investigations 8249, Bureau of Mines Report of Investigations (1977).

Also reported in this publication is prior work showing that an inert atmosphere is essential for the formation of a satisfactory coating of iridium, as well as rhodium, from a molten cyanide bath. This prior work is G. R. Smith, et al., *Plating,* Vol. 56, pp. 805–808 (July 1969). Finally, it is known in the prior art to construct a galvanic cell using sodium beta-alumina as a selective ion transport membrane. Illustrative of this type of prior art is D. R. Flinn, et al., *Journal of the Electrochemical Society,* Vol. 123(7), pp. 978–981 (July 1976).

However, this prior art does not provide a platinum-rhodium alloy of predetermined composition and thickness. This prior art does not provide a platinum-rhodium alloy coating that is substantially uniform throughout the coating. For example, the Andrews patent discussed above provides in example 11 a platinum-ruthenium alloy which varied in ruthenium concentration from 2 to 7%.

DISCLOSURE OF THE INVENTION

It is accordingly one object of the present invention to provide a process of obtaining a platinum-rhodium alloy coating of predetermined composition and thickness.

A further object of the present invention is to provide a process for obtaining such an alloy coating in which the composition of the alloy is substantially uniform throughout the electroplated coating.

Other objects and advantages of the present invention will become apparent as the description thereof proceeds.

In satisfaction of the foregoing objects and advantages, there is provided by this invention a process of electroplating a platinum-rhodium alloy coating of predetermined composition and thickness, on a metal substrate, the composition being substantially uniform throughout the electroplated coating. This process includes the steps of (a) immersing a first anode made of a platinum group metal and immersing a selective ion transport membrane containing a cathode and a first portion of a moisture-free, molten cyanide bath, into a second portion of the molten cyanide bath, the second portion being a selected quantity, and the molten cyanide bath containing a cyanide salt selected from the group consisting of sodium cyanide and a mixture of sodium and potassium cyanide, and the platinum group metal being either platinum or rhodium; (b) electrolytically dissolving the anodic platinum group metal into the second portion of the molten cyanide bath, using a current density of from about 1 to less than 25 ma/cm$^2$ for platinum, and of from about 1 to less than 50 ma/cm$^2$ for rhodium, whereby the resulting bath contains a predetermined quantity of the platinum group metal, wherein a platinum bath is prepared and a rhodium bath is prepared; (c) combining a selected weight of the platinum bath with a selected weight of the rhodium bath to produce a mixed bath having a predetermined ratio of platinum to rhodium; (d) immersing a second anode made of the platinum group metal, a metal cathode and a stable reference electrode into the molten mixed bath, said metal cathode functioning as said metal substrate; and (e) without agitating the molten mixed bath, electroplating platinum and rhodium onto the metal cathode, using a predetermined electrical charge, and alternating a platinum anode with a rhodium anode, as the second anode, while monitoring and controlling the deposition potential of the metal cathode whereby there is obtained the platinum-rhodium alloy coating, the coating substantially corresponding in composition to the metal composition of the mixed bath. In carrying out this process, each of these steps is performed in a dry, inert gas environment. Also provided is a process for forming very thick alloy deposits that includes the additional steps of electrodissolving a portion of the platinum-rhodium alloy coating in a dry, inert atmosphere at a potential sufficiently positive to ensure rapid dissolution of both the platinum and the rhodium, and repeating the electroplating and alloy electrodissolution steps, until the desired very thick coating is obtained.

BEST MODE FOR CARRYING OUT THE INVENTION

As discussed above, the present invention is concerned with a process of electroplating a platinum-rhodium alloy coating of predetermined composition and predetermined thickness on a metal substrate. The composition is substantially uniform throughout the coating layer. This process is made possible partly by the stability of a mixed bath containing a platinum cyanide complex and a rhodium cyanide complex. The stability of this bath is surprising in view of the marked instability of a mixed bath containing a platinum cyanide complex and an iridium cyanide complex.

In the first essential step of the process, an anode made of either platinum or rhodium and a selective ion transport membrane are immersed in a known quantity of a moisture-free, molten cyanide bath. The selective ion transport membrane contains a cathode and another portion of the molten cyanide bath. The cyanide bath is made of a cyanide salt that is suitably sodium cyanide or a mixture of sodium cyanide and potassium cyanide. A bath containing at about 50—50 weight percent mixture of sodium cyanide and potassium cyanide is especially preferred, since this bath has a lower melting point than other mixtures of sodium cyanide and potassium cyanide.

The moisture-free, cyanide bath is prepared by heating the cyanide salt at a temperature in excess of the melting point of the salt, in an oxygen-containing atmosphere, such as air, for a period of time sufficient to produce a bath containing the dried cyanide salt, and that is free of any carbon formed during melting of the cyanide salt. A sufficient time for carrying out this heating step is about 3 hours when a substantially equimolar mixture of sodium cyanide and potassium cyanide is heated at 600° C. The time, of course, varies depending upon the heating temperature that is selected. Any carbon formed is removed by oxidation and by settling to the bottom of the container in which the salt is melted, and then by decanting the molten salt. Alternatively, this drying step could be carried out in an inert atmosphere, such as helium, for a period of time sufficient to permit any carbon formed to agglomerate. The agglomerated carbon can be allowed to settle, with separation from the molten bath being achieved by decanting as in the previous procedure, or the molten bath can be filtered to remove the carbon. Filtration, rather than allowing the carbon to settle and then decanting, can also be used in the previous procedure. This drying step can be avoided by using an anhydrous cyanide salt as the starting material.

In the electrolysis cell prepared by the first step of the process, the anode and the selective ion transport membrane are immersed in a known quantity of the cyanide bath held by a container that functions as an outer container of the electrolysis cell. The selective ion transport membrane serves as an inner container. The outer container is constructed of any material that does not react with the cyanide salt, platinum or rhodium under the conditions used for the electrolytic dissolution of the platinum or rhodium anode to be described below, with exemplary materials being alumina, mullite and titanium.

The known quantity of the cyanide bath is transferred to the outer container either as a solid or a liquid. When the bath is prepared by the drying procedure described above, the bath may be allowed to solidify and be stored prior to use in the first step of the process.

As explained, the electrolysis cell cathode is maintained in a moisture-free, molten cyanide bath separate from that in which the anode is immersed by the selective ion transport membrane. The membrane permits the passing of an ion or ions of the cyanide salt between the outer and inner baths, but prevents passage of platinum or rhodium ions. Materials useful as the membrane contains ions of unit positive charge, in particular sodium ions, which are sufficiently mobile, that they can be made to move under the influence of an applied electric field. Sodium silicate glass, available commercially as EXAX ®, and sodium borosilicate glass, available commercially as Pyrex ®, are illustrative of glasses useful as the membrane. The mobility of these ions in the glass greatly increases as the temperature is raised. Ions of charge greater than 1, or of larger size, or of greater polarizability tend to be much less mobile in these glasses. Other solid-state ionic conductors, including sodium beta-alumina, may be useful as the membrane. The cathode is made of any electrically conducting material that does not react with the cyanide salt, platinum or rhodium under the electrolytic dissolution conditions. An illustrative material is graphite.

In a preferred embodiment of this electrolysis cell, a Pyrex ® glass test tube is used as the selective ion transport membrane and serves as the inner container. A portion of the cyanide bath described above, which contains a substantially equimolar mixture of sodium cyanide and potassium cyanide, is held in the test tube and a graphite cathode is immersed in the molten bath within the test tube. The test tube and a platinum or rhodium anode is immersed in a known amount of this cyanide bath. The platinum and rhodium serve as electrical leads dipping into the molten salt, and during electrolysis, dissolve to provide platinum and rhodium in a dissolved form in the outer bath. In chemical notation, this electrolysis cell is represented as follows, in the case of platinum:

$$Pt|Pt^{2+} \text{ in } NaCN\text{-}KCN|Pyrex|NaCN\text{-}KCN|Graphite$$

In the next essential step of the process, a platinum bath is prepared and also a rhodium bath. Bath preparation is achieved by electrolytically dissolving the platinum or rhodium anode into the cyanide bath in the outer container. A current density of from about 1 to less than 25 ma/cm$^2$ is used for platinum, and a current of from about 1 to less than 50 ma/cm$^2$ is used for rhodium. While higher current densities can be used, the platinum electrodes are subject to extensive loss of small metallic particles into the bath during passage of these higher current densities. As a result, the electrical charge passed through the cell cannot be correlated with the anode dissolution, and there can be interference with the adherence of the platinum-rhodium alloy coating. In the case of rhodium, higher current densities (or more positive electrode potentials) can result in significant oxidation of $Rh^{+1}$ to $Rh^{+2}$, resulting in a plating bath of unknown rhodium content.

The platinum bath contains a predetermined quantity of platinum, and the rhodium bath contains a predetermined quantity of rhodium. Predetermination is made possible by a predictable relationship between the weight of the anodic platinum group metal that electrolytically dissolves and the electrical charge (current x time) passed through the cell. The existence of this predictable relationship in the platinum electrolysis cell constitutes one of our discoveries. The electrolytic dissolution is carried out at a temperature of about 50° C. greater than the melting point of the cyanide bath. A suitable temperature, when the bath is a substantially equimolar mixture of sodium cyanide and potassium cyanide, is in the range of about 525° to 600° C.

Within the current ranges described above, the selection of a higher current requires a shorter time, whereas the selection of a lower current requires a greater time. For this reason, a current of less than about 1 ma/cm$^2$ is not practical. The electrical charge passed through the cell is suitably determined by using a current integrator in the external circuit. The platinum group metal bath prepared by this step conveniently contains about 1 weight percent of the metal.

In the third essential step of the process, there is produced a mixed bath containing platinum and rhodium having a predetermined ratio of platinum to rhodium. This mixed bath is prepared by combining a selected weight of the platinum bath with a selected weight of the rhodium bath. As an example, 50 g of the platinum bath containing 1 weight percent platinum is combined with 50 g of the rhodium bath containing 1 weight percent of rhodium to produce a mixed bath having a 1:1 ratio of platinum to rhodium. The mixed bath is immediately ready for use as a plating bath or may be allowed to cool and solidify for later use. The stability of this mixed bath is one of the important discoveries that make possible the process of this invention.

In the next essential step of the process, an electrolysis cell for electroplating platinum-rhodium alloy is prepared by immersing a platinum or rhodium anode, a cathode and a stable reference electrode in the molten mixed bath prepared by the previous step. The cathode used in this cell is composed of a metal substrate. Illustrative metal substrates are stainless steel, carbon steel, nickel, an alloy containing iron and chromium, and an alloy containing nickel, chromium, and iron, such as Inconel. Any other metal that is nonreactive under electroplating conditions and onto which a platinum-rhodium alloy may be coated is useful.

In the next essential step, platinum and rhodium alloy is electroplated onto the metallic cathode using a predetermined electrical charge, and alternating a platinum anode with a rhodium anode, while monitoring and controlling the deposition potential of the metal cathode. The platinum and rhodium anodes are alternated so as to maintain a nearly constant concentration of dissolved platinum and rhodium in the mixed bath, and to assure that the ratio of platinum to rhodium stays essentially constant. Thus, the platinum and rhodium in the alloy coated in the process is provided by the mixed bath prepared in the previous step and by additional dissolution of platinum and rhodium during the electroplating.

A very important feature of our process is the monitoring and controlling of the deposition potential of the cathode during electroplating to ensure the plating of an alloy coating that substantially corresponds in composition to the metal composition of the mixed bath. In other words, the alloy coating has substantially the same ratio of platinum to rhodium as the mixed bath. Thus, the alloy coating is of predetermined composition.

Deposition potential is monitored and controlled using a conventional potentiostat and the stable reference electrode. The requirements of the reference electrode are that it be suitable for use in the molten mixed bath and that it permit control of the deposition potential, as described above. A preferred electrode of this type is a silver, silver chloride electrode that is made up of a silver wire, immersed in a mixture containing about 98 weight percent silver chloride and about 2 weight percent sodium chloride. A sodium borosilicate glass membrane, such as is provided by a Pyrex® test tube, is suitably used to hold the silver wire and the silver chloride-sodium chloride mixture. Although this electrode is substantially known in the art, as illustrated by D. R. Flinn, et al., *Journal of the Electrochemical Society*, Vol. 123 (7), pp. 978–981 (July 1976), we have discovered that this electrode in combination with a conventional potentiostat makes possible the required monitoring and control of the deposition potential described above. There is hereby incorporated by reference into this application, FIG. 2 and the discussion concerning FIG. 2 in this article.

In carrying out this step of the process, the deposition is controlled to ensure that rhodium is deposited simultaneously with platinum and to prevent sodium and/or potassium metal from depositing on the metal cathode. Using the reference electrode described above, we have discovered that this requirement is met when the deposition potential is in a range of from about −2.1 v to less negative than about −2.4 v, with a potential of about −2.2 v being particularly preferred. At a potential slightly more negative than −2.2 v, sodium or potassium deposition begins, and at a potential more negative than −2.4 v, sodium reduction becomes very significant.

The electroplating step is preferably carried out without agitating the mixed bath. Agitation is avoided so that any particles in the mixed bath remain settled at the bath bottom and are not plated, and in order to provide for good control of the plating rate, since the rate of plating increases with agitation. If agitation were used during this step, then the mixed bath should contain less than about 1 weight percent of the platinum and rhodium.

As described above, we use potential-controlled electrodeposition in the electroplating step. We have discovered that this enables us to easily provide a platinum-rhodium alloy coating of predetermined composition. As an alternative to monitoring and controlling the deposition potential, the plating current could be controlled. The difficulty in controlling plating current is that the plating current changes with any change in temperature of the bath, thus producing an alloy that may not have the predetermined composition.

The electroplating is carried out in a container that suitably is composed of any material that does not react under electroplating conditions. Illustrative materials are alumina and mullite. When the mixed bath described above contains a substantially equimolar mixture of potassium cyanide and sodium cyanide, the electroplating is carried out at a temperature of about 570° C. For other mixtures of potassium cyanide and sodium cyanide or for a bath containing pure sodium cyanide, a temperature about 50° C. above the bath melting point is suitable. Although the cyanide salt used in this process could be pure potassium cyanide, a very long period of time would be required in the step of forming the platinum bath and rhodium bath, such that use of the pure potassium cyanide salt is impractical. For this reason, the cyanide bath containing a mixture of potassium cyanide and sodium cyanide conveniently has sufficient sodium cyanide present so that the platinum or rhodium dissolution takes place within a practical time frame.

Predetermination of the thickness of the alloy coating is made possible by a predictable relationship between the electrical charge that is selected, and the amount of alloy that is electroplated. Thus, by using a predetermined electrical charge, the alloy thickness is predetermined.

Using the silver electrode described in detail above as the reference electrode during the electroplating, the chemical notation for the electroplating cell is as follows:

$$M|Pt^{2+}+Rh^{+}\text{in NaCN-KCN}|\text{Pyrex}|\text{AgCl}+2\text{ wt-pct NaCl}|\text{Ag},$$

where M is Pt, or Rh. The cell described by this notation is a preferred embodiment of the electroplating cell.

A critical aspect of each of the essential steps described above is that the steps be carried out in a dry, inert gas environment, such as helium. In the event that it is desired to store the platinum bath, rhodium bath, or mixed bath, then storage should be in a dry, inert gas environment. This requirement of our process is different from the work of U.S. Pat. No. 3,547,789 to Andrews, et al., which discloses that exposure to air or oxygen is essential at certain points in the process thereof. The requirement of air or oxygen in the process thereof results from plating out of sodium and/or potassium metal at the cathode during dissolution of the platinum group metal, with subsequent reentering of the metallic sodium and/or potassium into the molten bath. The metallic sodium and/or potassium reacts with the dissolved ionic platinum group metal to reform metallic platinum group metal which precipitates to the bottom of the melt. However, when air is present, the metallic sodium and/or potassium reacts with the oxygen in air, rather than with the dissolved ionic platinum group metal.

As discussed above, the process of the present invention, in particular the electroplating step, produces a platinum-rhodium alloy coating that substantially corresponds in composition to the metal composition of the mixed bath. This coating is of predetermined composition, since the ratio of platinum to rhodium therein corresponds substantially to the ratio of platinum to rhodium in the mixed bath, and is of predetermined thickness, since thickness is determined by the electrical charge selected. Also, the alloy coating is substantially uniform in composition throughout the plated coating.

In an alternative embodiment of the electroplating step, a current reversal deposition technique, rather than the above direct current deposition technique, is used. Current reversal deposition permits the formation of very thick deposits of alloy with less dendrite formation than is observed in direct current deposition. Basically, in current reversal deposition, deposition is carried out for a period of time and then dissolution, with deposition and dissolution periods being repeated again and again to build up a deposit of the desired thickness and with the electrical charge for the deposition period being greater than the charge for the dissolution period.

The time used for the deposition portion of each cycle is long enough to permit development of a diffusion layer of defined, reproducible thickness, and the dissolution portion of the cycle is carried out at a potential sufficiently positive to ensure rapid dissolution of both the platinum and the rhodium. The deposition period is carried out in exactly the same way as the electroplating step, explained above. Therefore, maintaining the deposition potential at −2.2 v, when the silver, silver chloride electrode described above is used as the reference electrode, is preferred. About 200 seconds is exemplary of the time required for the deposition portion of each cycle. A potential of −1.475 v, using this reference electrode, is illustrative of the required potential for the dissolution portion of the cycle. When the deposition period is about 200 seconds, the dissolution period is advantageously about 20 seconds. In a preferred embodiment, using the particular reference electrode just mentioned, deposition is carried out at about −2.2 v for about 200 seconds and dissolution is carried out at about −1.475 v for about 20 seconds. The alloy electrodissolution is suitably carried out without agitating the molten mixed bath, just as in the case of electroplating, described above.

Prior to beginning current reversal deposition, the metal cathode is electroplated using the direct current deposition technique described above, until there is formed on the cathode a continuous alloy coating to prevent possible reaction with the molten bath, during current reversal. This alternative embodiment of the electroplating step is also carried out in a dry, inert gas environment, such as helium.

The platinum-rhodium alloy formed by our process can have any ratio of platinum to rhodium therein. A current density of about 4–10 ma/cm$^2$ is convenient for forming the platinum plating bath, and a current density of about 2–10 ma/cm$^2$ is convenient for forming the rhodium bath. The silver, silver chloride reference electrode described above, may be used during anodic electrodissolution.

Specific examples of the present invention will now be set forth. Unless otherwise indicated, all percents are weight/weight, and all steps are carried out at atmospheric pressure. It is to be understood that these examples are merely illustrative, and are not in any way to be interpreted as limiting the scope of the invention.

EXAMPLE 1

A moisture-free, solidified 303.7 g equimolar mixture of NaCN and KCN was placed into a 2.5 inch-diameter $Al_2O_3$ crucible. Inside the crucible were placed the following: (1) a platinum anode; (2) a 25 mm×150 mm Pyrex test tube that contained additional moisture-free equimolar NaCN and KCN sufficient to yield approximately equal liquid levels in the crucible and in the test tube after the cyanide mixture was molten; this tube also contained a 5 mm×200 mm graphite rod, which served as the cathode during the plating bath preparation; (3) a 3 mm ID, 5 mm OD Pyrex tube, sealed at the bottom, containing approximately 0.3 g of a mixture of silver chloride with 2 wt-pct sodium chloride; into this tube was placed a silver wire of sufficient length to contact the AgCl+NaCl mixture in the tube and extend above the tube to permit electrical contact. This assembled cell was heated in a helium atmosphere to 570° C. in approximately two hours. The bath was entirely molten at the end of this two-hour period. With the temperature maintained at 570°±10° C., and using an external power supply, the platinum electrode was made the anode and the graphite electrode was the cathode and a total current of approximately 150 ma, corresponding to a current density of about 5.5 ma/cm$^2$, was passed during an approximate two-hour period, for a total charge passed of 1688 coulombs. During this plating bath preparation, the potential of the platinum electrode remained between −1.48 v and −1.506 v versus the silver wire of the reference electrode. After the passage of 1688 coulombs, the external current supply was shut off and all of the electrodes and the test tube were removed. The molten plating bath was poured into a silica tray and allowed to solidify. This platinum-containing bath was then ready for mixing with rhodium-containing baths or for use to prepare pure platinum deposits. This platinum plating bath contained 1.7214 g of platinum on the basis of anode weight change and was calculated to contain 1.710 g of platinum on the basis of the number of coulombs passed. Therefore, the platinum concentration of this bath was 0.56 wt-pct.

EXAMPLE 2

Using the procedures of Example 1, 284.9 g of a moisture-free, solidified equimolar mixture of NaCN and KCN was placed into the alumina crucible. In this case, a current of 250 ma was passed through the cell, corresponding to a current density of approximately 9 ma/cm$^2$ for the platinum anode. The platinum dissolution was carried out at this approximate current for three hours, during which time a total of 2749 coulombs was passed. A total of 2.8688 g of platinum dissolved in the bath as determined by the anode weight loss and 2.779 g loss was calculated based on the total charge passed. During this platinum dissolution, the platinum electrode remained between −1.460 v and −1.509 v versus the silver wire of the reference electrode. Based on anode weight loss, the platinum concentration of this bath was 0.997 wt-pct and was 0.966 wt-pct based on total charge passed.

EXAMPLE 3

Using the procedure of Example 1, except that a rhodium electrode of approximately the same dimensions as the platinum electrode was used in place of the platinum, a rhodium-containing cyanide plating bath was prepared. In addition, two separate rhodium dissolution periods were used, separated by an overnight period and a melt cooling and solidification, followed by reheating and melting. For this bath preparation, 303.9 g of a previously dried equimolar mixture of NaCN and KCN was used. During the first dissolution period, and using an average current of approximately 225 ma, corresponding to a current density of approximately 8 ma/cm$^2$, a total charge of 2623 coulomb was passed through the cell and the rhodium anode lost 2.7121 g during a 3¼-hour period. In the second rhodium dissolution period, 287.2 coulomb of charge was passed and the rhodium anode lost 0.2976 g. At the end of these two rhodium dissolution periods, the bath contained 0.98 wt-pct rhodium based on rhodium anode weight loss and 1.01 wt-pct based on the charge passed. During the periods of rhodium dissolution, the rhodium anode remained at a potential of from −1.537 v to −1.586 v versus the silver wire of the reference electrode.

EXAMPLE 4

Using the procedure of Example 3, 100.0 g of a previously dried NaCN and KCN equimolar mixture was used to prepare a rhodium-containing cyanide plating bath. In this preparation, an average current of approximately 90 ma was passed through the cell, with approximate rhodium dissolution current density of 3 ma/cm$^2$. In 3½ hours, 965.0 coulomb of charge was passed through the cell and the rhodium anode lost 1.0152 g. On the basis of rhodium anode weight loss, the resulting bath was 1.00 wt-pct rhodium, and was 1.02 wt-pct based on the charge passed.

EXAMPLES 5–10

Five alloy plating baths were prepared by mixing together in each case a portion of the platinum-containing bath of Example 2, with a portion of the rhodium-containing bath of Example 3. The plating baths contain 18.7, 38.1, 48.0, 58.0, and 78.7 wt-pct platinum relative to the total platinum and rhodium. Additionally, 34.1 g of a moisture-free, equimolar mixture of sodium cyanide and potassium cyanide is added to the bath containing 18.7 wt-pct, and 34.0 g is added to the bath containing 38.1 wt-pct. Using iron-5 wt-pct chromium alloy as the deposition substrate, deposition was carried out in a helium atmosphere at 570° C. without agitating the bath. The cathode deposition potential was maintained at −2.2 v versus the silver-silver chloride reference electrode described earlier. The total time to prepare the coating, the average plating current, the total charge passed during deposition and the ratio of charge passed while using platinum anode to charge passed using rhodium anode is shown in Table 1. Following preparation, the composition of the coatings from each bath was determined by two destructive methods: fire assay-atomic absorption, and by chemical dissolution of the coating, followed by an X-ray flourescence analysis. The results of the analyses are shown in Table 2.

EXAMPLES 11–15

Following the procedure of Examples 5–10 and using the conditions set forth in Table 1, five alloy plating baths having the compositions shown in Table 1, were used to electrodeposit a platinum-rhodium alloy onto Inconel 600 substrates. The resulting electrodeposits were sectioned into four pieces for independent analyses using (1) X-ray diffraction to determine lattice cell constants of the coatings followed by comparison with known data for bulk alloys to determine the composition; (2) by proton-induced X-ray emission spectroscopy (PIXE); (3) by fire assay followed by atomic absorption determination; and (4) by dissolution followed by X-ray flourescence determination. The analytical results are shown in Table 2. The PIXE and X-ray diffraction results show the excellent correlation between the alloy composition and the bath composition.

TABLE 1

| Examples | Relative plating bath composition $\frac{\text{wt Pt}}{\text{wt (Pt + Rh)}} \times 100$ | Total time to prepare coating, minutes (approximate) | Average plating current, ma (approximate) | Total Charge passed during deposition, coloumbs | Ratio of charge passed while using platinum anode to charge passed while using rhodium, coulombs |
|---|---|---|---|---|---|
| 5 | 18.7 | 22 | 43 | 53.1 | 10.6/45.2 |
| 6 | 38.1 | 29 | 32 | 55.0 | 23.1/31.8 |
| 7 | 48.0 | 16 | 65 | 53.1 | 26.6/26.5 |
| 8 | 58.0 | 20 | 50 | 53.1 | 31.9/21.2 |
| 9 | 78.7 | 23 | 40 | 53.1 | 44.0/11.0 |
| 10 | 78.7 | 18 | 50 | 53.1 | 42.5/10.6 |
| 11 | 18.7 | 26 | 200 | 308 | 61.6/246.4 |
| 12 | 38.1 | 55 | 120 | 386 | 159.7/226.3 |
| 13 | 48.0 | 30 | 200 | 389 | 115.6/273.4 |
| 14 | 58.0 | 32 | 200 | 386 | 231.6/154.4 |
| 15 | 78.7 | 88 | 60 | 289 | 231.2/57.8 |

TABLE 2

| Example | Platinum Group Metal in Alloy, wt-pct: Fire assay/AA* Pt | Fire assay/AA* Rh | Dissolution/X-ray fluorescence* Pt | Dissolution/X-ray fluorescence* Rh | PIXE Pt | PIXE Rh | X-ray diffraction Pt | X-ray diffraction Rh |
|---|---|---|---|---|---|---|---|---|
| 5 | 21 | 79 | 21 | 78 | | | | |
| 6 | 33 | 67 | 38 | 62 | | | | |
| 7 | 54 | 46 | 51 | 49 | N/A | | N/A | |
| 8 | 59 | 41 | 68 | 32 | | | | |
| 9 | 77 | 23 | 75 | 25 | | | | |
| 10 | 80 | 20 | 78 | 22 | | | | |
| 11 | 27 | 73 | 13 | 87 | 16.1 | 83.9 | 17 | 83 |
| | 24 | 76 | 17 | 83 | | | | |
| 12 | 46 | 54 | 38 | 62 | 38.7 | 61.3 | 38.2 | 61.8 |
| | 40 | 60 | 41 | 59 | | | | |
| 13 | 47 | 53 | 44 | 56 | 47.9 | 52.1 | 43.5 | 56.5 |
| | 47 | 53 | 45 | 55 | | | | |
| 14 | 56 | 44 | 53 | 47 | 58.1 | 41.9 | 58.2 | 41.8 |
| | 56 | 44 | 55 | 45 | | | | |
| 15 | 74 | 26 | 72 | 28 | 77.6 | 22.4 | 76.4 | 23.6 |
| | 74 | 26 | 72 | 28 | | | | |

| | Current Reversal Deposition | PIXE Spot 1 Pt | PIXE Spot 1 Rh | PIXE Spot 2 Pt | PIXE Spot 2 Rh |
|---|---|---|---|---|---|
| 16 | N/A | 78.9 | 21.1 | 80.6 | 19.4 |
| 17 | | 79.0 | 21.0 | 78.0 | 22.0 |

*Duplicate samples determined by this method for Examples 11-15

EXAMPLES 16-17

Using the mixed plating bath used in Example 15, this bath containing 78.7 wt-pct platinum to total wt-pct of platinum and rhodium and containing a total of 1 wt-pct dissolved platinum and rhodium, two Inconel 600 substrates were electroplated as follows. With both Inconel substrates in the plating bath simultaneously and starting with a platinum anode, 80.1 coulomb of charge was passed using direct current plating at approximately 24 ma for 56 minutes, using a potential of −2.2 v versus the silver, silver chloride electrode described above, for the potential of the two Inconel substrates. The platinum anode was replaced with a rhodium anode and an additional 26.1 coulomb of charge was passed at a current of 22 ma for approximately 20 minutes, with the Inconel substrates again held at −2.2 v versus the reference electrode. This direct current deposition was conducted to form an initial, continuous coating on the Inconel substrates to prevent possible reaction of the substrates with the molten bath during the subsequent current reversal process. The current reversal process was then initiated by alternating the potential of the Inconel substrates between −2.2 v for 200 seconds and −1.475 v for 20 seconds. A deposition current of approximately 20 ma was observed when the samples were at −2.2 v, while the current observed at −1.475 v was a very large dissolution current that quickly became very small. This current reversal was continued for 3 hours. A rhodium anode was used for 36 minutes, while a platinum anode was used for 2 hours and 24 minutes of this 3 hour period. Based on the weight gain of the substrates and correcting for the initial direct current deposition, the effective deposition current was approximately 8 ma. The resulting deposits were visibly smoother than those prepared by direct current deposition. The composition of the coatings, as determined by proton-induced X-ray emission analysis, is given in Table 2 for two places on each coating. The coating was formed under a helium atmosphere without agitating the bath.

INDUSTRIAL APPLICABILITY

The process of this invention is useful for the preparation of protective coatings of controlled thickness of platinum-rhodium alloys of predetermined composition on high-strength, high-temperature metal substrates for the purpose of conserving the platinum metals and to increase the strength and usable lifetime over that of shapes made from bulk platinum and rhodium. One immediate application for the platinum-rhodium alloy coatings is that of protective coatings on containers used in high-temperature molten glass processing, such as glass fiber manufacturing and optical glass manufacturing. There are many other applications where platinum-rhodium alloys would be appropriate, but which are not used currently because of the high cost of using thick claddings or bulk alloy products. Potential applications include coatings which are corrosion and oxidation resistant for use in chemical processing, corrosion resistant electronic components, high-temperature energy conversion components, and in the formation of platinum-rhodium alloy catalysts. We claim:

1. A process of electroplating a platinum-rhodium alloy coating of predetermined composition and predetermined thickness on a metal substrate, the composition being substantially uniform throughout the coating, said process comprising the steps of (a) immersing a first anode made of platinum metal and immersing a selective ion transport membrane containing a cathode and a first portion of a moisture-free, molten cyanide bath, into a second portion of the molten cyanide bath; said second portion being a selected quantity; and the molten cyanide bath containing a cyanide salt selected from the group consisting of sodium cyanide and a mixture of potassium cyanide and sodium cyanide;

(b) electrolytically dissolving the anodic platinum metal into said second portion of the molten cyanide bath, using a current density of from about 1 to less than 25 ma/cm$^2$, whereby the resulting platinum bath contains a predetermined quantity of said platinum metal;

(c) repeating the procedure of steps (a) and (b) employing rhodium metal in place of platinum metal, and a current density of from about 1 to less than 50 ma/cm$^2$, whereby the resulting rhodium bath contains a predetermined quantity of said rhodium metal;

(d) combining a selected weight of said platinum bath with a selected weight of said rhodium bath to produce a mixed bath having a predetermined ratio of platinum to rhodium;

(e) immersing a second anode made of platinum or rhodium metal, a metal cathode and a stable reference electrode into the molten mixed bath; said metal cathode functioning as said metal substrate; and (f) without agitating the molten mixed bath, electroplating platinum and rhodium onto said metal cathode, using a predetermined electrical charge, and alternating said platinum anode with said rhodium anode, as said second anode, while monitoring and controlling the deposition potential of said metal cathode, whereby there is obtained said platinum-rhodium alloy coating, said coating substantially corresponding in composition to the metal composition of the molten mixed bath;

wherein each of said steps is carried out in a dry, inert gas environment.

2. The process of claim 1 further comprising the steps of (g) without agitating the molten mixed bath, electrodissolving a portion of said alloy coating in a dry, inert atmosphere at a potential sufficiently positive to ensure rapid dissolution of both the platinum and rhodium; and (h) repeating the electroplating and alloy electrodissolution steps until there is produced a very thick alloy coating of the desired thickness.

3. The process of claim 2 wherein said stable reference electrode is a silver, silver chloride electrode, and electrodissolution of the platinum and rhodium alloy coating is carried out at a potential of about −1.475 v.

4. The process of claim 1 wherein said selective ion transport membrane is a sodium silicate glass or a sodium borosilicate glass.

5. The process of claim 1 wherein said cathode is graphite.

6. The process of claim 1 wherein said stable reference electrode is a silver, silver chloride electrode.

7. The process of claim 6 wherein said deposition potential is maintained at about −2.2 v.

8. The process of claim 1 wherein said gas environment is helium.

9. The process of claim 1 wherein said cyanide salt is a substantially equimolar mixture of sodium cyanide and potassium cyanide.

10. The process of claim 1 wherein said current density is about 4–10 ma/cm$^2$ for platinum, and about 2–10 ma/cm$^2$ for rhodium.

* * * * *